US007146945B2

(12) United States Patent
Persson

(10) Patent No.: US 7,146,945 B2
(45) Date of Patent: Dec. 12, 2006

(54) APPARATUS FOR AN INTERNAL COMBUSTION ENGINE

(75) Inventor: Per Persson, Partille (SE)

(73) Assignee: Volvo Lastvagnar AB, Gothenburg (SE)

( * ) Notice: Subject to any disclaimer, the term of this patent is extended or adjusted under 35 U.S.C. 154(b) by 101 days.

(21) Appl. No.: 11/307,553

(22) Filed: Feb. 13, 2006

(65) Prior Publication Data

US 2006/0112918 A1 Jun. 1, 2006

Related U.S. Application Data

(63) Continuation of application No. PCT/SE2004/001223, filed on Aug. 23, 2004.

(30) Foreign Application Priority Data

Aug. 25, 2003 (SE) ..... 0302289

(51) Int. Cl.
*F01L 1/34* (2006.01)

(52) U.S. Cl. ..... 123/90.16; 123/90.15; 123/90.39; 123/90.31

(58) Field of Classification Search ..... 123/90.16, 123/90.15, 90.39, 90.31
See application file for complete search history.

(56) References Cited

U.S. PATENT DOCUMENTS 4,768,467 A * 9/1988 Yamada et al. ..... 123/90.16
6,257,201 B1 7/2001 Kajiura et al.

FOREIGN PATENT DOCUMENTS

| | | |
|---|---|---|
| EP | 0294682 | 12/1988 |
| WO | WO03031778 | 4/2003 |
| WO | WO03067067 | 8/2003 |

OTHER PUBLICATIONS

International Search Report from corresponding International Application No. PCT/SE2004/001223.

* cited by examiner

*Primary Examiner*—Thomas Denion
*Assistant Examiner*—Zelalem Eshete
(74) *Attorney, Agent, or Firm*—White, Redway & Brown LLP

(57) ABSTRACT

The invention relates to an apparatus for an internal combustion engine which for each cylinder with associated piston has at least one inlet valve and at least one exhaust valve for controlling the connection between the combustion chamber in the cylinder and an intake system and an exhaust system respectively. A rotatable camshaft with a cam lobe is designed to interact with a main rocker arm and a secondary rocker arm, the two rocker arms serving to transmit the movement of the cam lobe to the inlet/exhaust valve. The cam lobe is arranged to act on both of the rocker arms during each revolution of the camshaft. The secondary rocker arm interacts with a hydraulic piston, which is displaceable in a hydraulic cylinder and which forms part of a hydraulic circuit having a hydraulic fluid source, and which permits switching between at least two different working positions.

19 Claims, 11 Drawing Sheets

APPARATUS FOR AN INTERNAL COMBUSTION ENGINE

The present application is a continuation of PCT/SE2004/001223, filed Aug. 23, 2004, which claimed priority of SE 0302289-4, filed Aug. 25, 2003, both of which are incorporated by reference.

The present invention relates to an apparatus for an internal combustion engine which for each cylinder with associated piston has at least one inlet valve and at least one exhaust valve for controlling the connection between the combustion chamber in the cylinder and an intake system and an exhaust system respectively, a rotatable camshaft with a cam curve having at least one cam lobe being designed to interact with a main rocker arm and a secondary rocker arm, the two rocker arms serving to transmit the movement of the cam lobe to the inlet/exhaust valve.

There are numerous examples of the need to be able to adjust the valve lift in inlet or exhaust valves of an internal combustion engine. Such examples include the activation/deactivation of a compressed-air brake on an internal combustion engine for heavy road vehicles (additional valve movement only operative in engine braking); the generation of valve lift curves of differing width of the Miller-cycle type, for example, for use at different operating points in the engine working range; complete deactivation of the valve movement when isolating certain cylinders at partial load etc., and the institution of internal exhaust gas recirculation via the exhaust valve or via the inlet valve.

When the facility is required for fixing a rocker arm part in relation to another part, for example, an actuator is required that can overcome the forces occurring between the various parts without any impact occurring when movement of the rocker arm parts relative to one another approaches the limit positions. The movement of the rocker arm is controlled by a cam curve having one or more lobes which define what movements and accelerations the constituent parts must perform in order to achieve the required lifting movements, and this gives rise to forces and torsion in the mechanism.

It is desirable that apparatuses for producing additional openings of valves should not extend significantly in a longitudinal direction in the space available for the engine valve mechanism. For example, the high compression ratios that occur in modern diesel engines mean that the valve mechanism must be designed for very high contact-pressures. Furthermore, engines of this type may be fitted with some form of compressed-air brake, which requires space for actuating members. Consequently no apparatuses for switching between two valve operating modes should encroach on the existing compressed-air brake system. It is also desirable to be able to perform this switch from one mode to another in a simple way.

It is furthermore desirable to be able to continuously vary a Miller cycle independently of the crank angle, for variable closure of the inlet valves, for example. Being able to alter the lift curve of the inlet valves during operation may be advantageous at certain operating points in order to achieve lower overall exhaust emission and fuel consumption levels over a running cycle. In order that an engine with a Miller function in the valve lift curve might not exhibit very inferior starting or poor instantaneous response at low speeds, when turbo-charging affords little power, a valve lift profile with normal angle range is required, whilst the Miller cycle can be activated when turbo-charging at high power in order to reduce the compression temperature, thereby achieving a lower nitrogen oxide emission level, for example.

It is desirable to provide an apparatus which permits switching from one valve operating mode to another in an internal combustion engine, within the functional constraints described above.

According to an aspect of the present invention, an apparatus is provided for an internal combustion engine, the engine having at least one cylinder and associated piston, each cylinder and associated piston having at least one inlet valve and at least one exhaust valve, the apparatus being adapted to control a connection between a combustion chamber in the cylinder and an intake system and an exhaust system respectively. The apparatus comprises a rotatable camshaft with a cam curve having at least one cam lobe, a main rocker arm and a secondary rocker arm, the cam curve of the rotatable camshaft having at least one cam lobe, the at least one cam lobe being designed to interact with the main rocker arm and the secondary rocker arm, the two rocker arms serving to transmit movement of the cam lobe to a valve. The cam lobe is arranged to act on both of the rocker arms during each revolution of the camshaft, and the secondary rocker arm interacts with a hydraulic piston which is displaceable in a hydraulic cylinder and which forms part of a hydraulic circuit having a hydraulic fluid source, and which permits switching between at least two different working positions.

BRIEF DESCRIPTION OF THE DRAWINGS

The invention will be described in more detail below, with reference to examples of embodiment shown in the drawings attached, in which.

DETAILED DESCRIPTION

Figure 1:
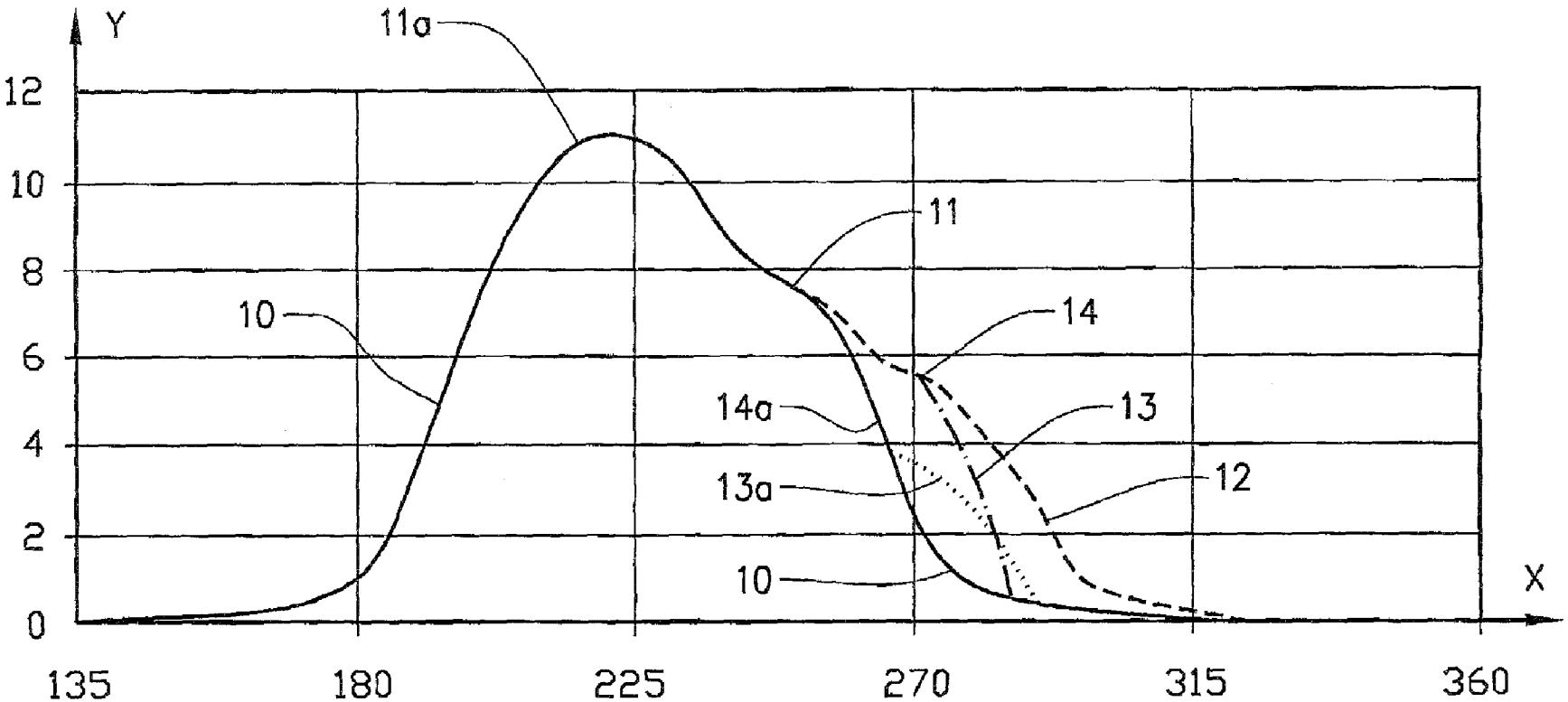
FIG. 1 is a curve diagram with various cam lift curves, which can be produced with a valve system according to the present invention.
Figure 2:
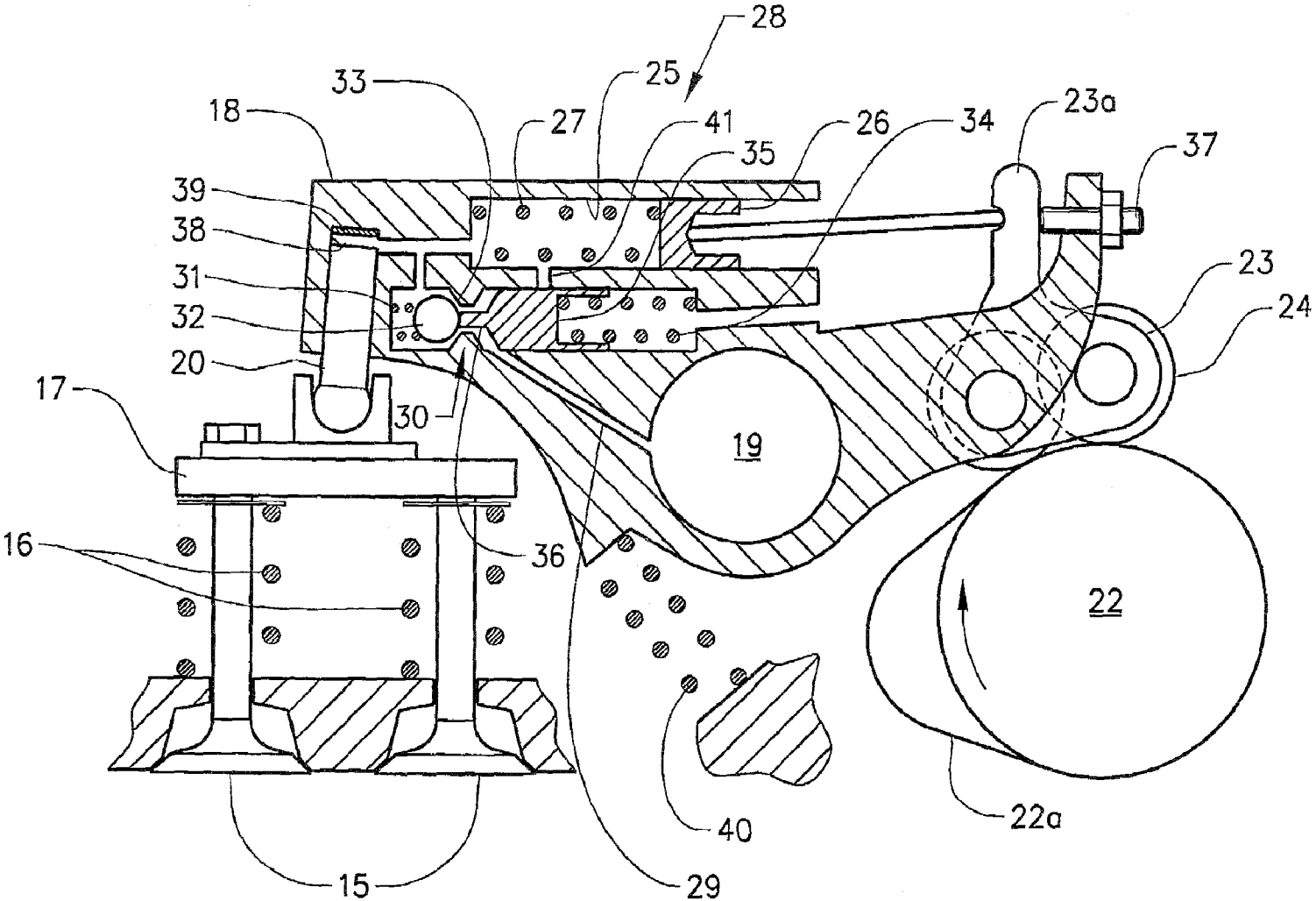
FIGS. 2–6 show schematic representations of a valve mechanism in various operating positions with the facility for switching between two operating modes according to the invention, FIG. 7 likewise shows one operating position for a second example of embodiment of the invention, and FIGS. 8–11 likewise show various operating positions of a valve mechanism according to a third example of embodiment of the invention.

In the curve diagram shown in FIG. 1 the X-axis gives the cam degrees and the Y-axis the lift height. The curve diagram includes a basic curve 10 drawn with a solid line, which at point 11 can be widened along the curve section 12 drawn with a dashed line, in order to produce a delayed closure of inlet valves, so-called delayed Miller cycle, for example. Depending on the geometry between rocker arms, cam lobe and rocker arm rollers, which affects the valve movement, the inlet valves are thereby kept open approximately 20 degrees longer than the valve opening afforded by the basic curve 10, that is to say the inlet valves are kept open during a certain first part of the engine compression stroke. This gives a lower temperature in the ensuing combustion/expansion and hence a reduced nitrogen oxide content in the exhaust gases. The Miller cycle is described, for example, in U.S. Pat. No. 2,670,595.

Valve closure according to the curve section 12 can be achieved with all the examples of embodiment of the invention described below. With the example of embodiment of the invention shown in FIGS. 8–11 it is also possible to achieve continuously variable valve closure within the area between the basic curve 10 and the curve section 12. This is illustrated in FIG. 1 by the curve section 13 drawn with a dash-dot line which proceeds from point 14 on the curve section 12. Curve 13*a* relates to an example of the conditions in which activation of a Miller cycle occurs during actual valve closure, according to examples of embodiment shown in FIGS. 2 to 7.

The valve mechanism shown in schematic form in FIGS. 2–12 is located on a cylinder head and comprises double-seat valves 15 with valve springs 16 and a common yoke 17.

The yoke is actuated by a main rocker arm 18, which is pivotally supported on a rocker arm shaft 19. On one side of the shaft 19 the main rocker arm 18 has a valve depressor 20, which interacts with the yoke 17, and on the other side a rocker arm roller 21, which interacts with a rotatable camshaft 22 having a cam lobe 22*a*. The main rocker arm 18 is furthermore provided with a secondary rocker arm 23, which is pivotally supported at the outer end of the arm and has a second rocker arm roller 24. The cam lobe 22*a* has a lift curve which means that the second rocker arm roller 24 comes into contact with the cam lobe, once the first roller 21 has reached its maximum lift and is in descending motion, with low relative speed at point 11, see FIG. 1. That is to say the cam lobe 22*a* comes into contact with point 11 and the rocker arm roller 21 at the same time that a corresponding point IIa resumes cam lobe contact with the rocker arm roller 24. These two points give virtually the same rocker arm lift and rocker arm speed so that the rolling contact between cam lobe and roller 24 will be resumed without impact.

The secondary rocker arm 23 is coupled by way of an angled section 23*a* to a hydraulic piston 26, which is arranged in a hydraulic cylinder 25 in the main rocker arm and which is acted upon by a helical coil spring 27.

The hydraulic piston 26 is a part of a hydraulic circuit 28, arranged in the main rocker arm and supplied with hydraulic fluid via a feed duct 29, which is connected to the pressure side of the engine lubricating system. The hydraulic circuit also comprises a control valve 30.

In the examples of embodiments of the invention shown in FIGS. 2–7 the control valve 30 takes the form of a pressure-controlled non-return valve, which is controlled via the feed duct 29 that supplies an adjustable pilot pressure (1–4 bar). The spring 31 presses a ball 32 against a seat 33. A second spring 34 presses on an operating piston 35 and the spring force in the second spring 34 is stronger than in the spring 31 this means that at a low hydraulic pressure the spring 34 and the operating piston 35 with its peaked end section 36 press the ball 32 away from the seat 33, as can be seen from FIG. 2, and the hydraulic fluid can flow in both directions in the feed duct 29. In this working position the hydraulic piston 26 connected to the secondary rocker arm 23 can move freely in the hydraulic cylinder 25, which means that the movement of the main rocker arm is generated solely by the contact of the rocker arm roller 21 with the camshaft 22.

Figure 3:
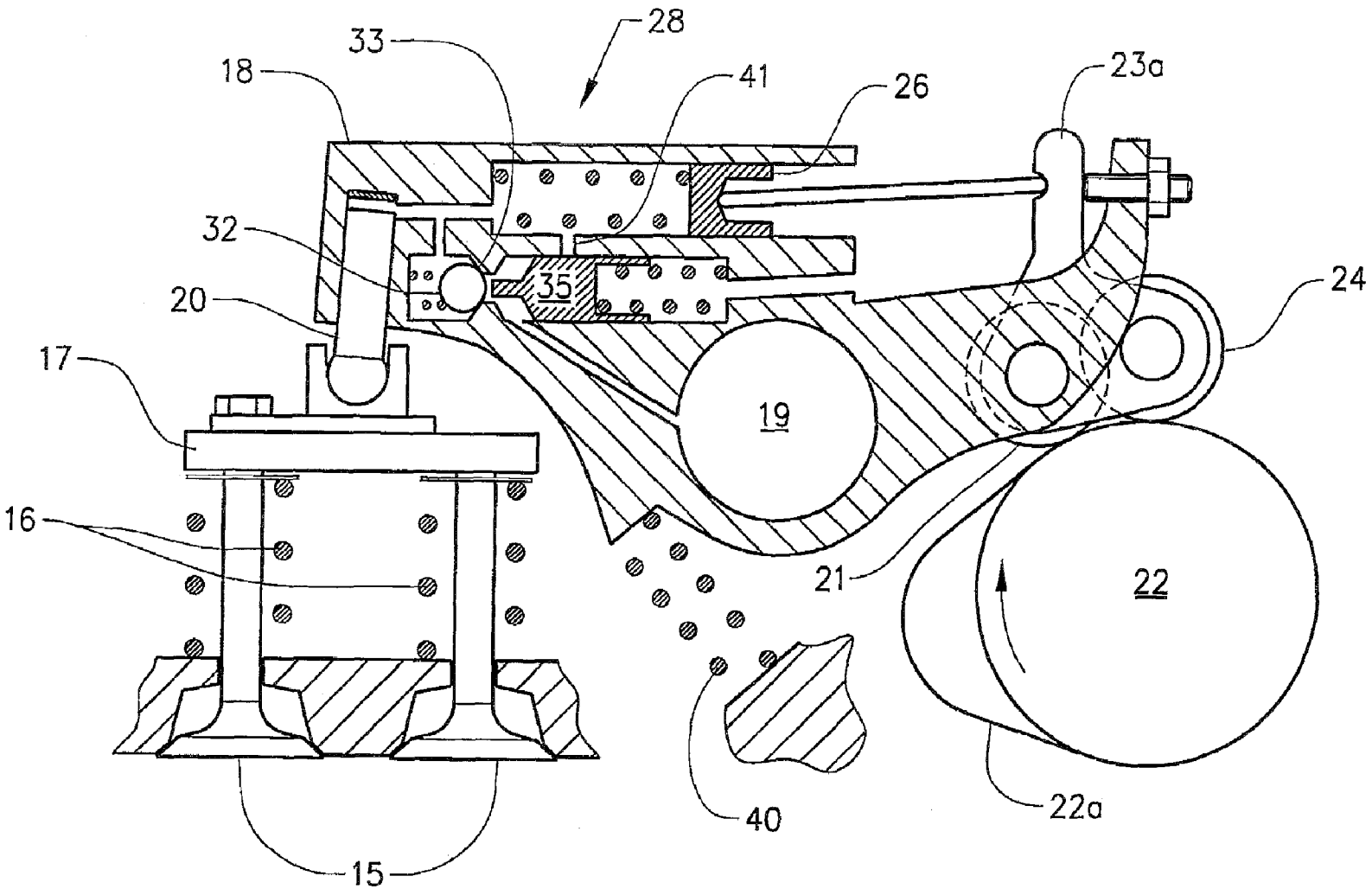
Figure 4:
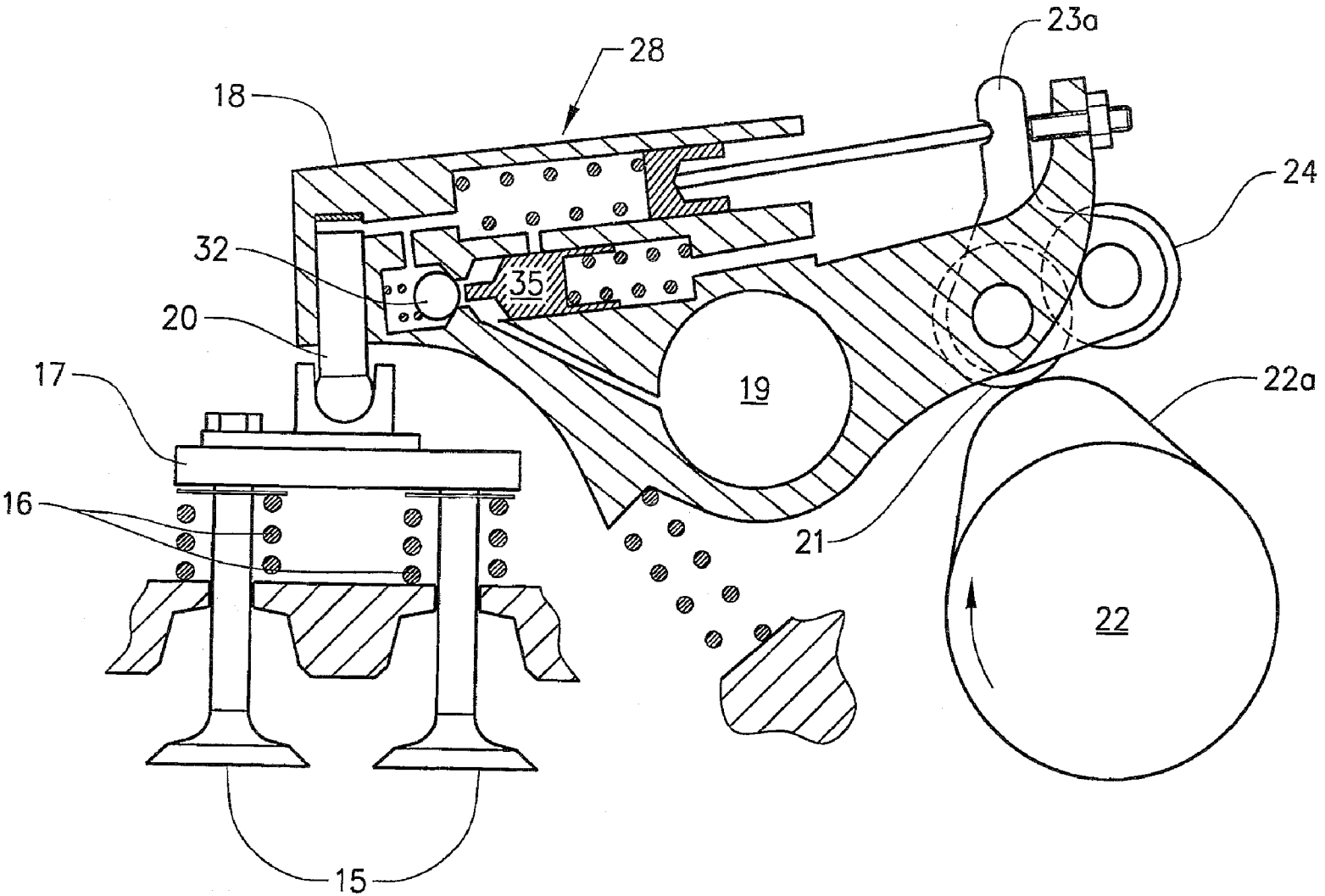
Figure 5:
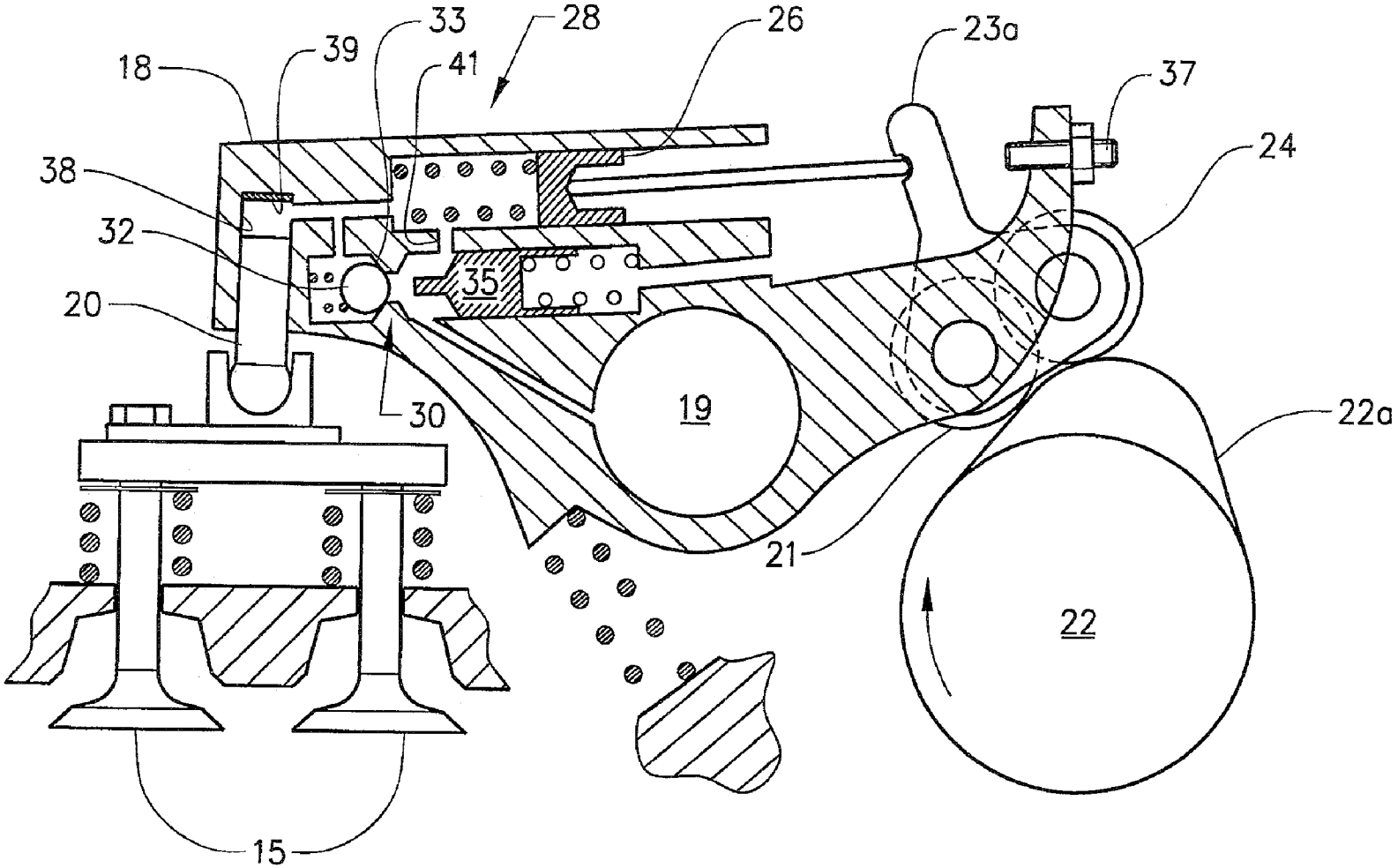

At a hydraulic pressure exceeding a certain specific value, this pressure acting on the operating piston 35 overcomes the force of the spring 34 and the operating piston 35 is pressed away from the ball 32, which thereby closes against the seat 33 (see FIG. 3). The hydraulic fluid present between the hydraulic cylinder 25 and the non-return valve is now confined and the secondary rocker arm 23 is activated. When the inlet valves 15 have been fully opened and the cam lobe 22*a* comes into contact with the secondary rocker arm 23 (see FIGS. 4 and 5), the movement of this rocker arm 23 with the hydraulic piston 26 away from the adjustable stop screw 37 will mean that the hydraulic fluid causes the valve depressor 20 to move in a cylindrical bore 38 in the main rocker arm 21. As a result, the valve opening movement departs from the basic curve 10 (see FIG. 1) and follows the curve section 12.

The secondary rocker arm therefore performs the same movement in both of the working positions described above, but in the latter position the movement is hydraulic transmitted to the valve depressor 20. In order to damp the closing movement at the transition from active to inactive working position (curve section 13 or 13*a* in FIG. 1), when the valves 15 are on the point of closing, the bore 38 is provided with an elastic and/or viscous damping element 39. A helical coil spring 40, which ensures that the rocker arm 18 always has contact with the camshaft 22, is furthermore provided.

Figure 6:
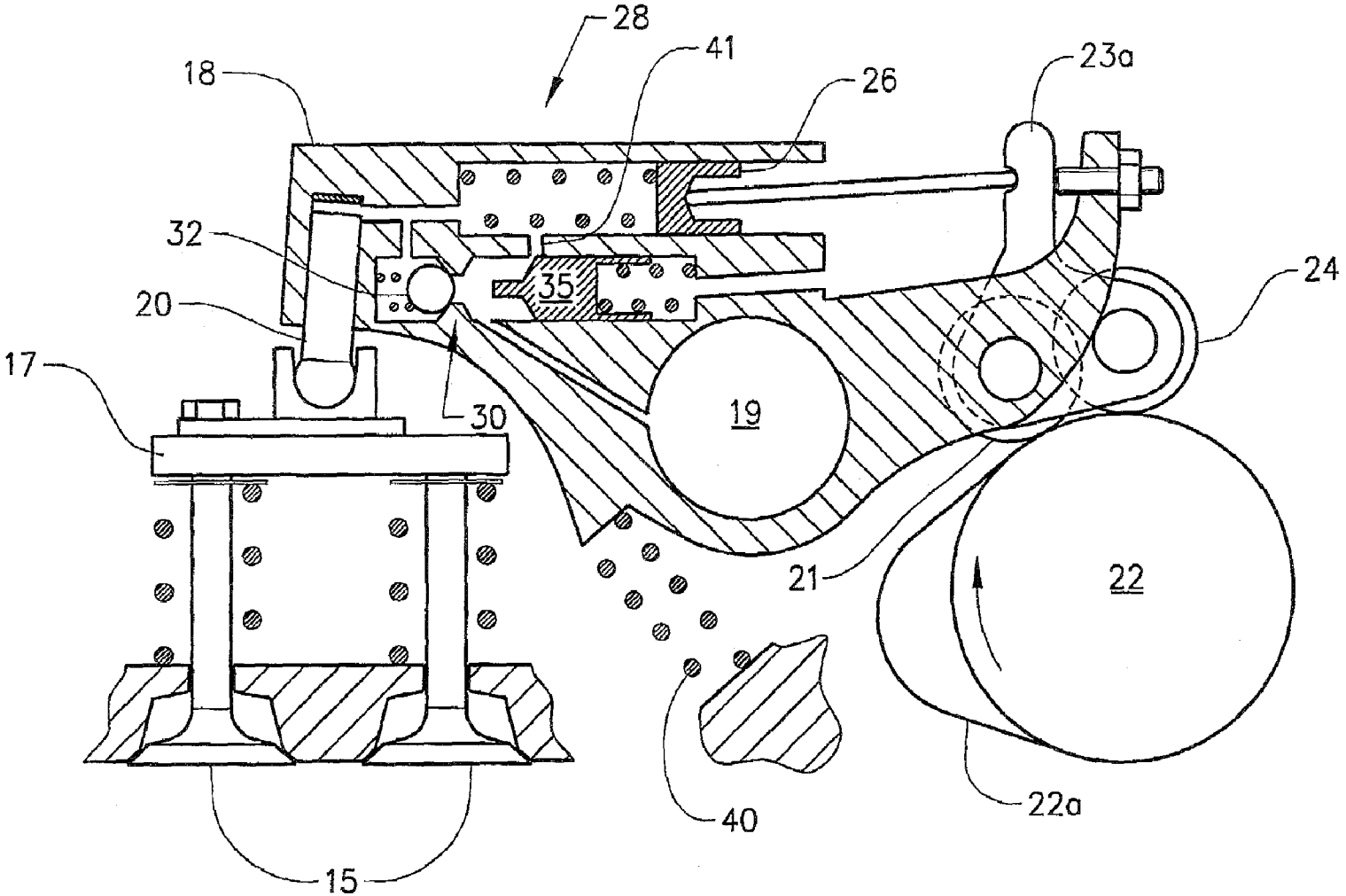

In the event of a further increase in hydraulic pressure, the operating piston 35 moves to expose a passage 41, which connects the hydraulic cylinder 25 to the feed duct 29 (see FIG. 6). In this working position the valve lift resumes the lifting motion according to curve 10 in FIG. 1. The lubricating oil pressure increased to the third pressure level may be used to activate some other function, such as an engine brake device, without the delayed Miller lift curve here described being activated.

Figure 7:
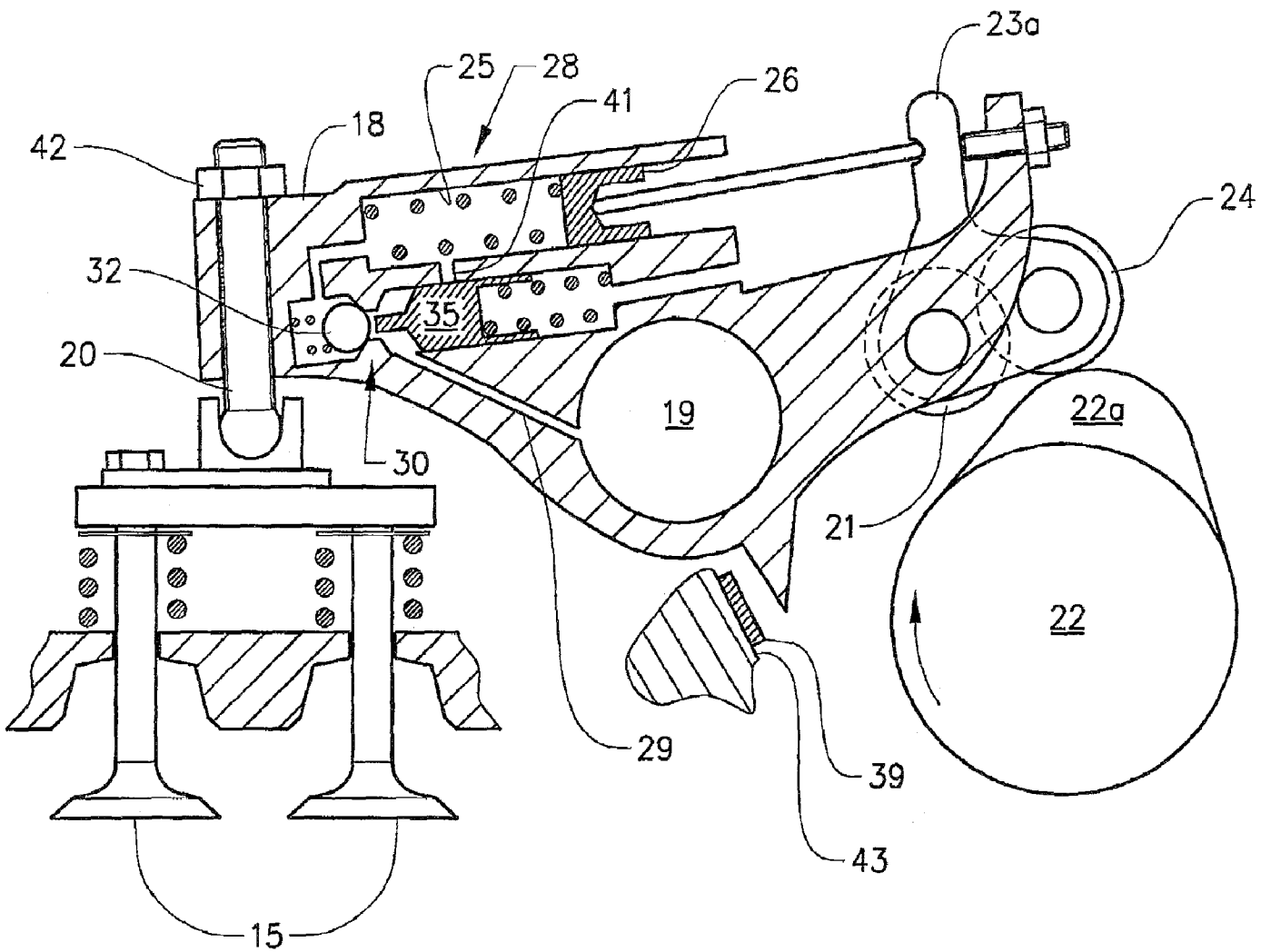

FIG. 7 shows a variant of the example of an embodiment of the invention described above, in which the valve depressor 20 is immovably/adjustably fitted to the main rocker arm 18 by means of a screw thread and a nut 42.

In functional terms this does not make any significant difference. However, the damping element 39 needs to be moved so that it acts between the main rocker arm 18 and a fixed point 43 in the engine.

FIGS. 8 to 11 show a further example of an embodiment of the invention in which the pressure-controlled valve 30 is replaced by a mechanically adjustable hydraulic valve 44. As in the examples of embodiment described above, this valve 44 comprises a non-return valve having a spring 31, which presses a ball 32 against a seat 33.

The feed duct 29, however, connects directly to the seat 33 of the non-return valve. A dumping duct 45 is arranged in the main rocker arm 18, so that it connects a point downstream of the non-return valve to a port in the wall of the hydraulic cylinder 25. The dumping duct 45 can be opened and closed by means of a rotary valve 46, which is connected via a linkage 47 to an adjusting device (not shown) on the cylinder head 48. When the main rocker arm moves about the shaft 19 the dumping duct 45 is automatically opened and closed. The linkage 47 between the main rocker arm 18 and the cylinder head 48 is used in order to transmit the desired proportion of the valve lift range and to define, in terms of the crank angle, the point at which closure of the extended valve lift is to commence. The hydraulic piston 26 also functions as a valve for the hydraulic fluid that is to be drained out of the hydraulic circuit in that the piston, in its outermost position, when the secondary rocker arm 23 is on the base circle, covers the dumping duct 45 in series with the rotary valve 46. This is in order to reduce the consumption of oil, which would otherwise flow out freely when both roller followers are on the base circle of the cam, see FIG. 8.

Figure 8:
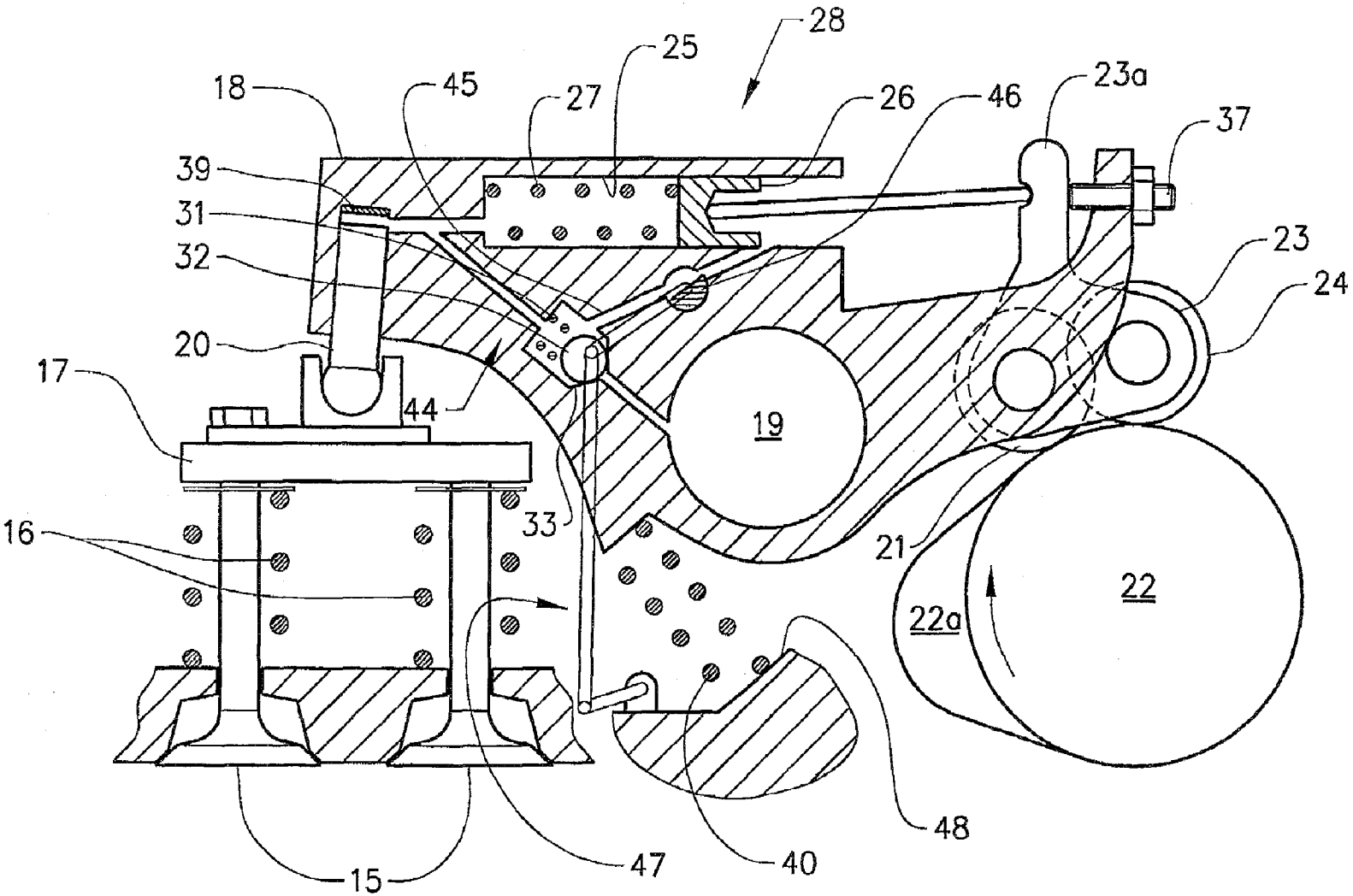
Figure 9:
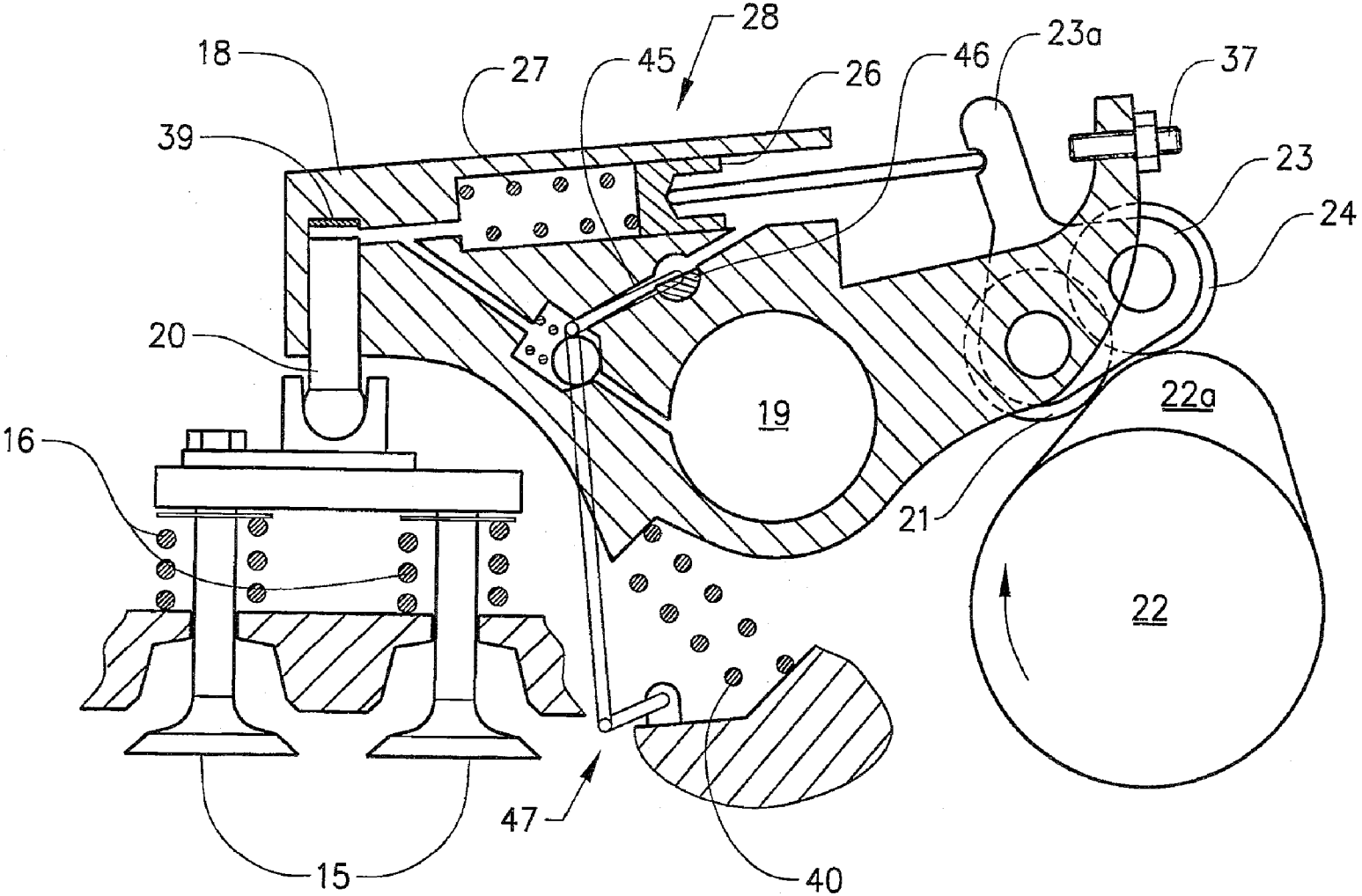

FIGS. 8 and 9 show the hydraulic valve 44 set for basic function, that is to say for following the basic curve 10 with rotary valve 46 open.

Figure 10:
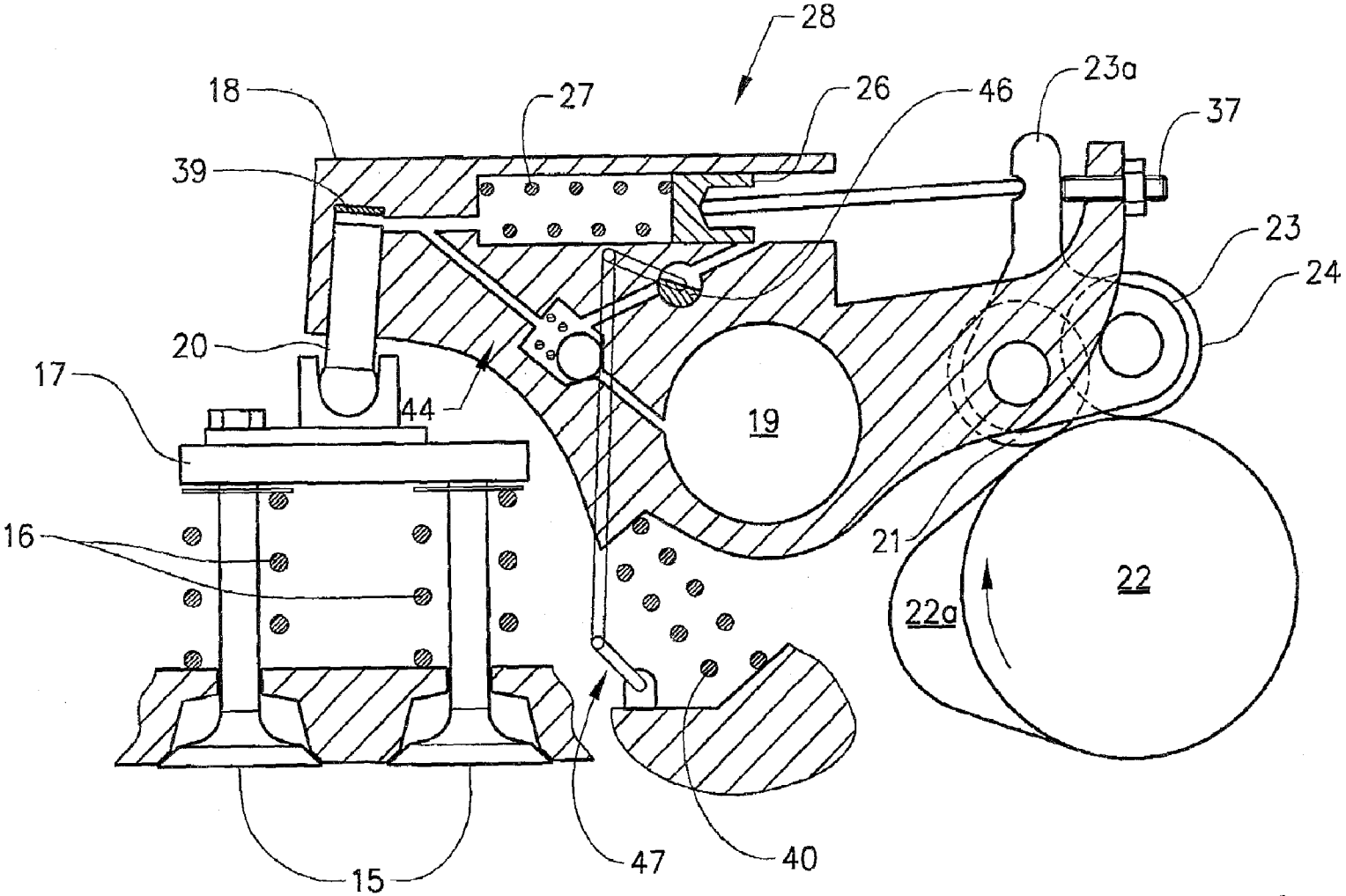
Figure 11:
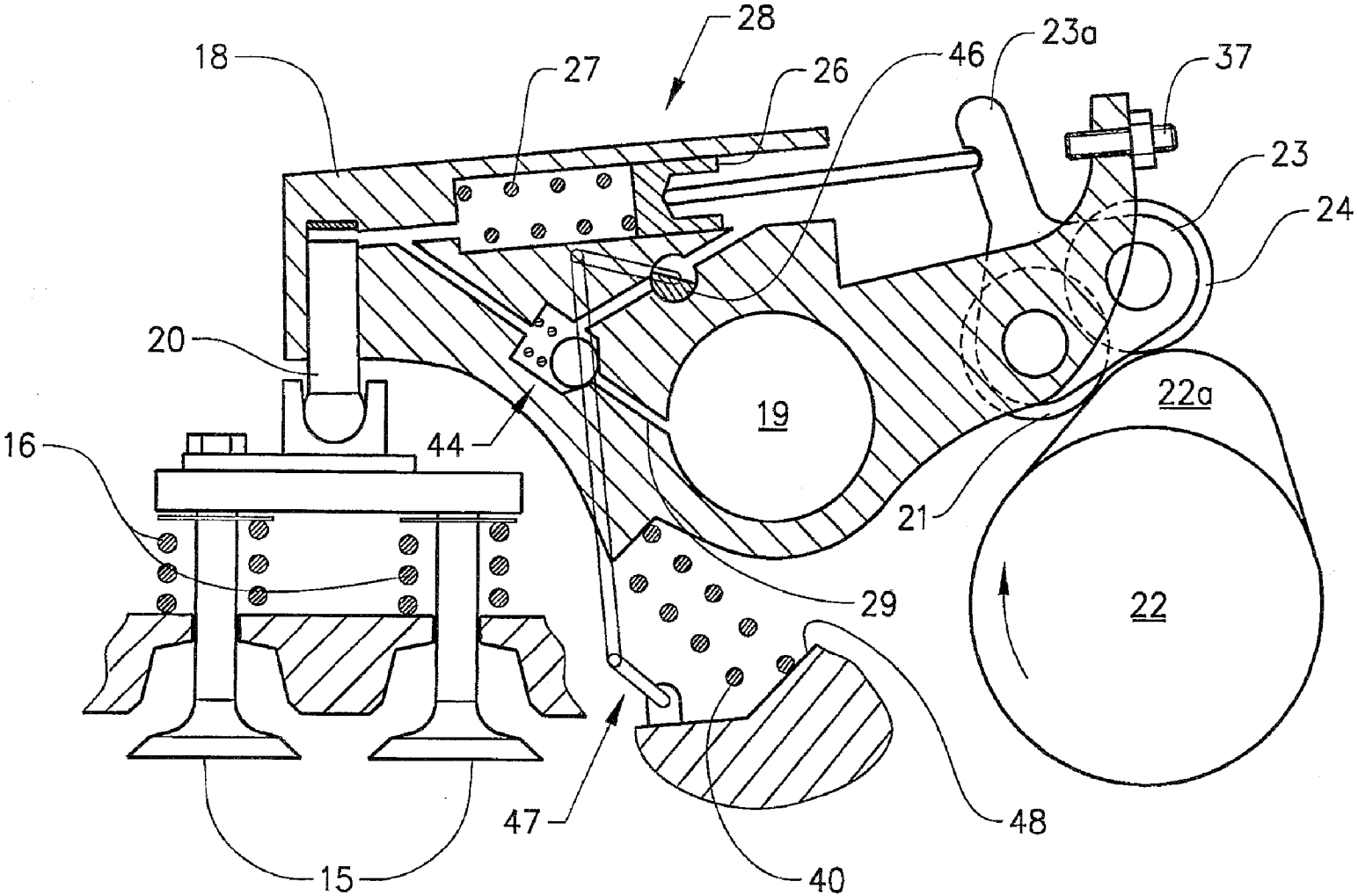

FIGS. 10 and 11 show the hydraulic valve 44 set for the Miller function, that is to say for following the curve 12 with rotary valve 46 closed, for example.

In the example of embodiment described above the linkage 47 between cylinder head and rotary valve is designed with levers and push rod. Alternatively, a rack and pinion mechanism might be used. A further variant could comprise a control rod along the length of the engine which is provided with a wedge-shaped body directly opposite each inlet rocker arm. If this control rod is made to reciprocate in the longitudinal direction of the engine, the wedge-shaped bodies can actuate a hydraulic valve in the main rocker arm 18 at various angular positions of the main rocker arm, thereby starting to dump oil at various crank angles and providing a continuously variable closure of the inlet valve.

The invention must not be regarded as being limited to the examples of embodiment described above, a number of further variants and modifications being feasible without departing from the scope of the following claims.

What is claimed is:

1. An apparatus for an internal combustion engine, the engine having at least one cylinder and associated piston, each cylinder and associated piston having at least one inlet valve and at least one exhaust valve, the apparatus being adapted to control a connection between a combustion chamber in the cylinder and an intake system and an exhaust system respectively, comprising:

a rotatable camshaft with a cam curve having at least one cam lobe;

a main rocker arm and a secondary rocker arm, the cam curve of the rotatable camshaft having at least one cam lobe, the at least one cam lobe being designed to interact with the main rocker arm and the secondary rocker arm, the two rocker arms serving to transmit movement of the cam lobe to a valve, wherein the cam lobe is arranged to act on both of the rocker arms during each revolution of the camshaft, and the secondary rocker arm interacts with a hydraulic piston which is displaceable in a hydraulic cylinder and which forms part of a hydraulic circuit having a hydraulic fluid source, and which permits switching between at least two different working positions.

2. The apparatus as claimed in claim 1, wherein the hydraulic circuit comprises a control valve and a non-return.

3. The apparatus as claimed in claim 2, wherein the hydraulic circuit in one of the working positions forms a hydraulic interlock between the main rocker arm and the secondary rocker arm.

4. The apparatus as claimed in claim 2, wherein the hydraulic circuit in one of the working positions forms a hydraulic interlock between the secondary rocker arm and a valve depressor which is arranged in the main rocker shaft and interacts with the valve.

5. The apparatus as claimed in claim 2, wherein the control valve is designed to open and close a dumping duct which leads away from the hydraulic circuit from a point downstream of the non-return valve.

6. The apparatus as claimed in claim 5, wherein the control valve is actuated by a pivot movement of the main rocker arm so that the control valve opens and closes at a certain rocker arm angle.

7. The apparatus as claimed in claim 6, wherein the angle is adjustable by way of a mechanical connection to the engine.

8. The apparatus as claimed in claim 2, wherein the control valve can be operated by switching between two or more pressure levels in the hydraulic circuit.

9. The apparatus as claimed in claim 8, wherein the hydraulic circuit in one of the working positions forms a hydraulic interlock between the main rocker arm and the secondary rocker arm.

10. The apparatus as claimed in claim 8, wherein the hydraulic circuit in one of the working positions forms a hydraulic interlock between the secondary rocker arm and a valve depressor which is arranged in the main rocker shaft and interacts with the valve.

11. The apparatus as claimed in claim 9, wherein the control valve is designed to open and close a dumping duct which leads away from the hydraulic circuit from a point downstream of the non-return valve.

12. The apparatus as claimed in claim 11, wherein the control valve is actuated by a pivot movement of the main rocker arm so that the control valve opens and closes at a certain rocker arm angle.

13. The apparatus as claimed in claim 12, wherein the angle is adjustable by way of a mechanical connection to the engine.

14. The apparatus as claimed in claim 1, wherein the hydraulic circuit in one of the working positions forms a hydraulic interlock between the main rocker arm and the secondary rocker arm.

15. The apparatus as claimed in claim 14, wherein movement of the main rocker arm towards the camshaft is limited by a damping element.

16. The apparatus as claimed in claim 1, wherein the hydraulic circuit in one of the working positions forms a hydraulic interlock between the secondary rocker arm and a valve depressor which is arranged in the main rocker shaft and interacts with the valve.

17. The apparatus as claimed in claim 16, wherein the valve depressor in an inner limit position interacts with a damping element.

18. The apparatus as claimed in claim 16, wherein movement of the main rocker arm away from the camshaft occurs against action of a spring member.

19. The apparatus as claimed in claim 1, wherein the cam lobe is designed with a width such that after it has passed the main rocker arm it catches the secondary rocker arm at a lower landing speed than it catches the main rocker arm.

* * * * *